US006058723A

United States Patent [19]

Kusunoki et al.

[11] Patent Number: 6,058,723

[45] Date of Patent: May 9, 2000

[54] CONTROLLER OF REFRIGERATOR

[75] Inventors: Atsushi Kusunoki; Shigeru Niki; Takuya Kishimoto, all of Tokyo, Japan

[73] Assignee: Kabushiki Kaisha Toshiba, Kanagawa-ken, Japan

[21] Appl. No.: 09/257,716

[22] Filed: Feb. 25, 1999

[30] Foreign Application Priority Data

Sep. 16, 1998 [JP] Japan ..... 10-261969

[51] Int. Cl.[7] ..... F25D 21/00

[52] U.S. Cl. ..... 62/156; 62/155; 62/234

[58] Field of Search ..... 62/156, 155, 157, 62/234

[56] References Cited

U.S. PATENT DOCUMENTS

| | | | |
|---|---|---|---|
| 4,499,738 | 2/1985 | Motoyama et al. | 62/155 |
| 4,646,536 | 3/1987 | Yamada et al. | 62/234 |
| 5,363,669 | 11/1994 | Janke et al. | 62/155 |
| 5,816,054 | 10/1998 | Yoo et al. | 62/80 |
| 5,842,355 | 12/1998 | Kalis et al. | 62/234 |

FOREIGN PATENT DOCUMENTS

| | | | |
|---|---|---|---|
| 58-217177 | 12/1983 | Japan | F25D 11/02 |
| 1-137185 | 5/1989 | Japan | F25D 21/08 |

*Primary Examiner*—Henry Bennett
*Assistant Examiner*—Marc Norman
*Attorney, Agent, or Firm*—Limbach & Limbach, LLP

[57] ABSTRACT

There is provided a refrigerator capable of suppressing intra-compartment temperature from rising during a defrosting operation by means of a defrosting heater and capable of preventing temperature of foods from rising after the defrosting operation. The inventive refrigerator sets temperature for ending a freezing mode during a pre-cooling operation at pre-cooling freezing mode ending temperature which is lower than temperature during a normal operation by a predetermined temperature and conducts an alternate cooling operation until when the pre-cooling operation ends based on the pre-cooling freezing mode ending temperature.

12 Claims, 4 Drawing Sheets

CONTROLLER OF REFRIGERATOR

BACKGROUND OF THE INVENTION

1. Field of the Invention

The present invention relates to a controller of a refrigerator having two evaporators.

2. Description of the Related Art

Among the recent refrigerators, there have been proposed ones having a refrigerating evaporator and a freezing evaporator to efficiently cool a refrigerator compartment and a freezer compartment, respectively.

In order to efficiently cool those two evaporators by refrigerant sent from one compressor, a three-way valve is disposed on the way of a passage of the refrigerant to decide to send the refrigerant to the refrigerating evaporator or the freezing evaporator by switching the three-way valve. In concrete, the following operation is carried by utilizing the three-way valve.

That is, a refrigerating mode of flowing the refrigerant to the both refrigerating evaporator and freezing evaporator and a freezing mode of flowing only to the freezing evaporator may be realized by switching the three-way valve. During the normal operation, an alternate cooling operation of conducting the freezing mode and the refrigerating mode is carried out.

In such a refrigerator, a defrosting operation has been conducted by actuating defrosting heaters provided in the vicinity of the evaporators after lowering compartment temperature by cooling the freezer compartment or the refrigerator compartment continuously for a certain period of time (this operation will be called a pre-cooling operation hereinafter) after when an accumulated operation time of the compressor has reached a preset time.

However, the defrosting operation described above has had the following problems.

Firstly, the refrigerator compartment is not cooled at all and the intra-compartment temperature of the refrigerator compartment rises during when the freezer compartment is continuously cooled by the alternate cooling operation described above and when the defrosting operation is conducted by means of the heater.

Secondly, when the normal alternate cooling operation is conducted after ending the defrosting operation, air warmed by the defrosting heater flows into the freezer compartment or the refrigerator compartment and hits against foods within the compartment, thus raising temperature of the foods.

Accordingly, in view of the problems described above, it is an object of the present invention to provide a refrigerator which is capable of suppressing the rise of the intra-compartment temperature during the defrosting operation by means of the defrosting heater and of preventing the temperature of the foods from rising after ending the defrosting operation.

SUMMARY OF THE INVENTION

According to a first aspect of the invention, a controller of a refrigerator comprising a refrigerant passage by connecting a compressor, a condenser, a refrigerator reducing member, a refrigerating evaporator corresponding to a refrigerator compartment, a freezer reducing member and a freezing evaporator corresponding to a freezer compartment; capable of realizing an alternate cooling operation of alternately conducting a refrigerating mode of flowing refrigerant to the refrigerating evaporator and to the freezing evaporator via the refrigerator reducing member and a freezing mode of flowing the refrigerant only to the freezing evaporator via the freezer reducing member by switching the refrigerant passage by a valve member; and comprising defrosting heaters provided for the freezing evaporator and the refrigerating evaporator, respectively, so as to be able to conduct a defrosting operation, respectively; wherein the improvement comprises that the refrigerator further comprises a refrigerator fan for blowing air cooled by the refrigerating evaporator to the refrigerator compartment; a freezer fan for blowing air cooled by the freezing evaporator to the freezer compartment; a refrigerator compartment sensor for detecting temperature of the freezer compartment; and a control means for conducting a pre-cooling operation for a preset pre-cooling operation time and for conducting the defrosting operation thereafter; and that the control means sets temperature for ending the freezing mode during the pre-cooling operation at pre-cooling freezing mode ending temperature which is lower than normal freezing mode ending temperature by a predetermined temperature and conducting the alternate cooling operation until the pre-cooling operation ends based on the pre-cooling freezing mode ending temperature.

According to a second aspect of the invention, the controller of the refrigerator described in the first aspect of the invention is characterized in that the control means lowers the pre-cooling freezing mode ending temperature stepwise per every predetermined time.

According to a third aspect of the invention, the control means of the refrigerator described in the first aspect lowers the pre-cooling freezing mode ending temperature stepwise every time when the alternate cooling operation is conducted once.

According to a fourth aspect of the invention, the controller of the refrigerator described in the first aspect is characterized in that the control means continues the pre-cooling operation until when the freezing mode ends when it is on the way of the freezing mode when the time reaches to the pre-cooling operation time.

According to a fifth aspect of the invention, the controller of the refrigerator described in the first aspect is characterized in that the control means continues the freezing mode further to continue the pre-cooling operation until when the freezing mode ends after ending the refrigerating mode when it is on the way of the refrigerating mode when the time reaches to the pre-cooling operation time.

According to a sixth aspect of the invention, the controller of the refrigerator described in the first aspect is characterized in that the control means drives the refrigerator fan during the defrosting operation when the defrosting operation of only the freezing evaporator is to be conducted.

According to a seventh aspect of the invention, the controller of the refrigerator described in the first aspect is characterized in that the control means switches to the refrigerating mode after ending the defrosting operation and returns to the normal alternate cooling operation after conducting at least a defrost recovering operation of turning the freezer fan reversely.

According to an eighth aspect of the invention, the controller of the refrigerator described in the seventh aspect is characterized in that the control means rotates the freezer fan reversely until when temperature detected by a freezing evaporator temperature sensor drop to a certain temperature.

According to a ninth aspect of the invention, the controller of the refrigerator described in the seventh aspect is characterized in that the control means turns the freezer fan at the lowest possible set speed.

According to a tenth aspect of the invention, the controller of the refrigerator described in the seventh aspect is characterized in that the control means starts the normal alternate cooling operation from the refrigerating mode after conducting the defrost recovering operation.

According to an eleventh aspect of the invention, the controller of the refrigerator described in the seventh aspect is characterized in that the control means returns the operation of the refrigerator to the normal alternate cooling operation after conducting a forced cooling operation by rotating the refrigerator fan and the freezer fan concurrently for a certain period of time after conducting the defrost recovering operation.

According a twelfth aspect of the invention, the controller of the refrigerator described in the eleventh aspect is characterized in that the control means rotates the refrigerator fan and the freezer fan at the lowest possible set speed.

The refrigerator of the first aspect of the invention will be explained. The control means conducts the alternate cooling operation until when the pre-cooling operation ends based on the pre-cooling freezing mode ending temperature for ending the freezing mode during the pre-cooling operation which is lower than normal freezing mode ending temperature by a predetermined temperature.

While the freezing mode must be set to lower the intra-compartment temperature of only the freezer compartment to defrost the freezing evaporator, the refrigerator compartment is not cooled and temperature of the refrigerator compartment rises in such a case. Then, above-mentioned control is carried out to suppress the temperature of the refrigerator compartment from rising by cooling the temperature of the freezer compartment below the normal state by setting the pre-cooling freezing mode ending temperature which is the temperature for ending the freezing mode during the pre-cooling operation below the normal freezing mode ending timing during the normal operation by the predetermined temperature.

The refrigerator of the second aspect will be explained. When the pre-cooling freezing mode ending temperature is lowered suddenly to low temperature, a number of revolutions of the compressor, the freezer fan or the refrigerator fan increases because the cooling capacity of the refrigerator must be suddenly increased, thus increasing noise level and power consumption increase as a result.

Therefore, the pre-cooling freezing mode ending temperature is lowered gradually per every predetermined time to end the pre-cooling operation. Thereby, it is not necessary to raise the cooling capacity suddenly.

The refrigerator of the third aspect will be explained. The pre-cooling freezing mode ending temperature is lowered stepwise every time when the alternate cooling operation is conducted once to end the pre-cooling operation in order to prevent the cooling capacity from increasing suddenly also in the refrigerator of the third aspect similarly to the refrigerator of the second aspect.

The refrigerator of the fourth aspect will be explained. Even after an elapse of the pre-cooling operation, there is a possibility that the defrosting heater is actuated in the state in which the intra-compartment temperature of the freezer compartment is not fully lowered and that the intra-compartment temperature rises at the moment of time when the mode is switched to the freezing mode. Therefore, the pre-cooling operation is continued, when the mode is the freezing mode, until when the freezing mode ends even after the elapse of the pre-cooling operation time. Thereby, the temperature of the freezer compartment is fully lowered.

The refrigerator of the fifth aspect will be explained. The pre-cooling operation is continued, when the mode is the freezing mode, until when the freezing mode ends even after the elapse of the pre-cooling operation time also in the refrigerator of the fifth aspect similarly to the refrigerator of the fourth aspect. Thereby, the defrosting operation is conducted by means of the heater in the state in which the refrigerator compartment and the freezer compartment are fully cooled.

The refrigerator of the sixth aspect will be explained. When the refrigerator of the sixth aspect conducts the defrosting operation of only the freezing evaporator, it also defrosts the refrigerating evaporator by driving the refrigerator fan. Although the refrigerating evaporator is not defrosted by the heater, the flow of air caused by the refrigerator fan allows the refrigerating evaporator to be defrosted, the distribution of intra-compartment temperature to be improved, the compartment to be humidified and the freshness of foods to be kept for a long period of time.

The refrigerator of the seventh aspect will be explained. Temperature of air around the evaporator is high due to heat caused by the defrosting heater after the end of the defrosting operation. Therefore, when the freezer fan is driven right after the end of the defrosting operation, the warm air hits directly against the foods within the compartments, thus raising the temperature of the foods. In order to prevent that, the freezer fan is rotated reversely after the end of the defrosting operation to return the warm air once into the refrigerator from the inlet of the original duct and then the air is blown out via the cooled freezing evaporator. Thus, it is possible to suppress the temperature of the foods from rising.

The refrigerator of the eighth aspect will be explained. The freezer fan is rotated reversely during the defrost recovering operation until when the temperature detected by the freezing evaporator temperature sensor drops to certain temperature. Thereby, it is possible to suppress the temperature of the foods from rising by hitting the cold air to the foods after fully cooling the freezing evaporator.

The refrigerator of the ninth aspect will be explained. Because a quantity of blown air needs not be great during when the freezer fan is rotated reversely, it is rotated in the lowest possible set speed in order to suppress the noise level and the power consumption.

The refrigerator of the tenth aspect will be explained. The refrigerator compartment is not cooled during the time from the pre-cooling operation to the defrosting operation and the intra-compartment temperature of the refrigerator compartment rises as a result. Therefore, the alternate cooling operation is started so as to cool the refrigerator compartment by the refrigerating mode after conducting the defrost recovering operation.

The refrigerator of the eleven aspect will be explained. The intra-compartment temperature of the refrigerator compartment and the freezer compartment rises because they are not cooled for a certain period of time during the defrost recovering operation. Then, the freezer fan and the refrigerator compartment are driven in the same time to send air cooled by the freezing evaporator and the refrigerating evaporator to the refrigerator compartment and the freezer compartment to cool the both compartments. This will be called a forced cooling operation.

The refrigerator of the twelfth aspect will be explained. When the forced cooling operation is conducted by driving the freezer fan and the refrigerator fan in the same time, a quantity of exchanged heat becomes large and the vaporization temperature of the both evaporators becomes high when their number of revolutions is great. Then, the number of revolutions of the both fans is minimized so that the vaporization temperature does not rise because the compartments are warmed up in contrary when the freezer fan is driven when the vaporization temperature is high.

The specific nature of the invention, as well as other objects, uses and advantages thereof, will clearly appear from the following description and from the accompanying drawings in which like numerals refer to like parts.

DESCRIPTION OF THE PREFERRED EMBODIMENTS

A refrigerator 10 according to one embodiment of the invention will be explained below based on the drawings.

Figure 1:
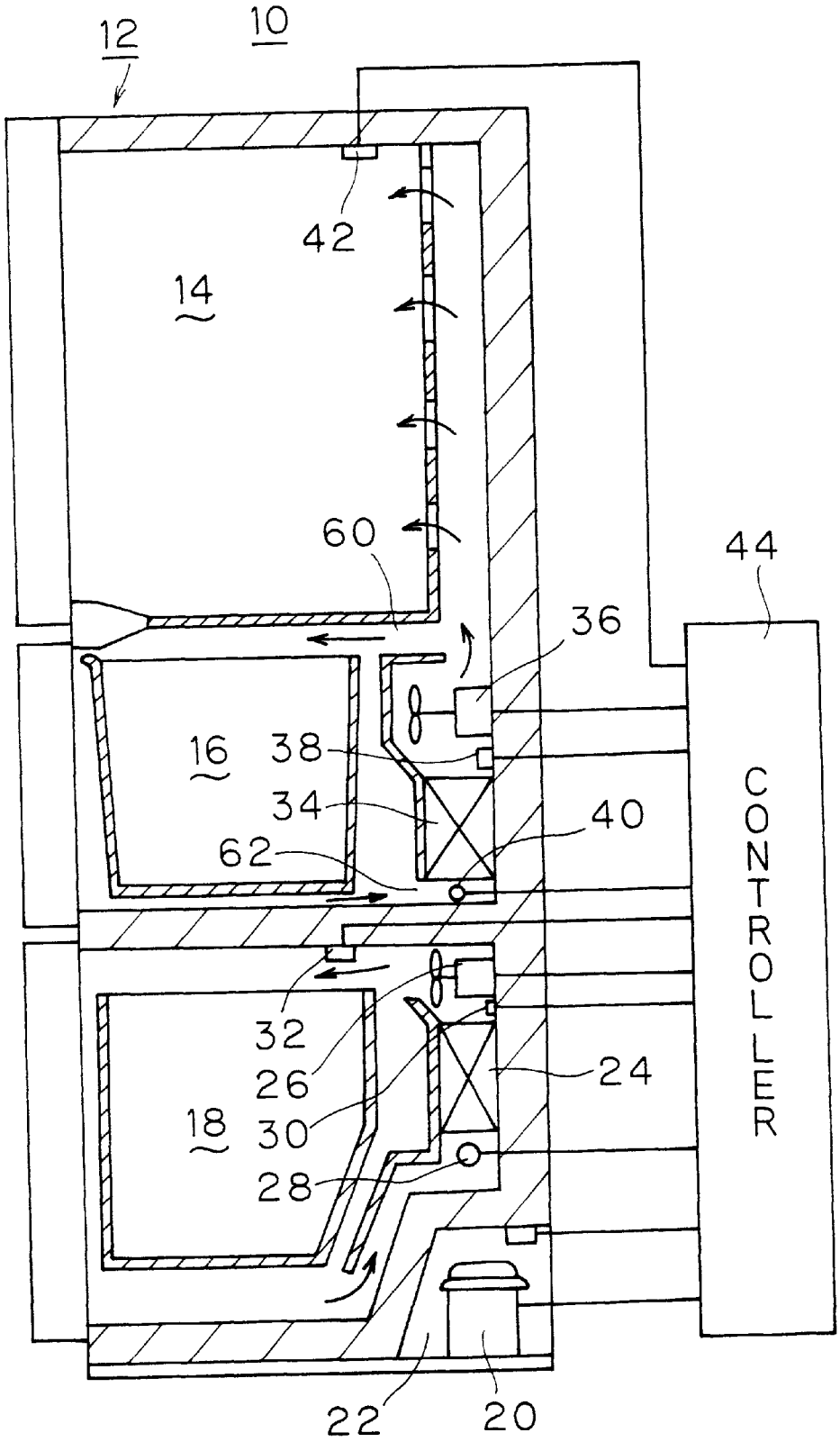
FIG. 1 is a diagram for explaining a refrigerator according to one embodiment of the present invention.
Figure 2:
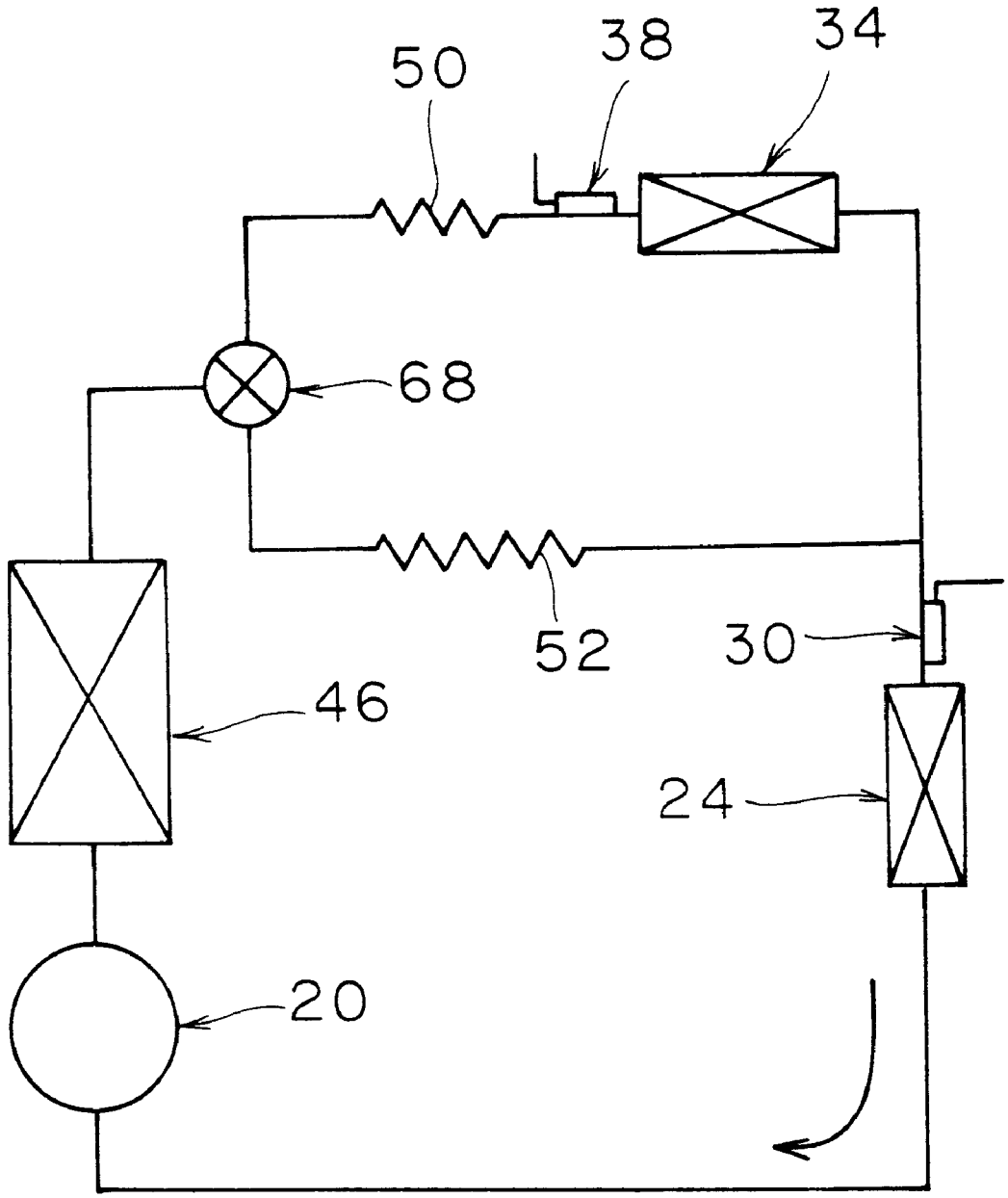
FIG. 2 is a diagram for explaining a refrigeration cycle.

FIG. 1 is a schematic longitudinal section view of the refrigerator 10. This diagram also illustrates an electrical system. FIG. 2 is a diagram for explaining a refrigeration cycle of the refrigerator 10.

The refrigerator 10 will be explained based on FIG. 1 at first. In a cabinet 12 of the refrigerator 10, there are provided a refrigerator compartment 14, a vegetable compartment 16 and a freezer compartment 18 in this order from the top. It is noted that an ice making unit not shown is provided in the freezer compartment 18.

A machine compartment 22 in which a compressor 20 is disposed is provided at the bottom of the back of the freezer compartment 18. A freezer compartment evaporator (hereinafter referred to as an F evaporator) 24 is disposed behind the freezer compartment 18 and a freezer compartment fan (hereinafter referred to as an F fan) 26 for blowing cold air generated by the F evaporator 24 to the freezer compartment 18 is provided above the F evaporator 24. A defrosting heater (hereinafter referred to as F defrosting heater) 28 for defrosting the F evaporator 24 is provided under the F evaporator 24. An F evaporator sensor 30 for detecting temperature of the F evaporator 24 is provided in the vicinity above the F evaporator 24.

A freezer compartment temperature sensor (hereinafter referred to as an F sensor) 32 for detecting intra-compartment temperature of the freezer compartment 18 is provided therein.

A refrigerator compartment evaporator (hereinafter referred to as an R evaporator) 34 is provided on the back of the vegetable compartment 16. A refrigerator compartment fan (hereinafter referred to as an R fan) 36 is provided above the R evaporator 34. An R evaporator sensor 38 for detecting temperature of the R evaporator 34 is provided in the vicinity above the R evaporator 34. A defrosting heater (hereinafter referred to as an R defrosting heater) 40 for defrosting the R evaporator 34 is provided under the R evaporator 34.

A refrigerator compartment temperature sensor (hereinafter referred to as an R sensor) 42 for detecting intra-compartment temperature of the refrigerator compartment 14 is provided therein.

The F fan 26, the F defrosting heater 28, the F evaporator sensor 30, the F sensor 32, the R fan 36, the R evaporator sensor 38, the R defrosting heater 40 and the R sensor 42 are connected to a control unit 44 composed of a microcomputer. The controller 44 comprises one substrate and is provided at the upper part of the back of the cabinet 12. A motor of the compressor 20 is also connected to the controller 44.

Next, a flow of the cold air will be explained based on FIG. 1.

The cold air cooled by the F evaporator 24 is blown by the F fan 26 and circulates within the freezer compartment 18. The cold air cooled by the R evaporator 34 is blown by the R fan 36 and circulates within the vegetable compartment 16 and the refrigerator compartment 14.

Next, the structure of the refrigeration cycle will be explained based on FIG. 2.

A condenser 46 is connected to the compressor 20 and a three-way valve 68 is connected to the condenser 46. One of refrigerant passages bifurcated from the three-way valve 68 is connected to the R evaporator 34 via a refrigerator compartment capillary tube (hereinafter referred to as an R capillary tube) 50 and the other refrigerant passage bifurcated from the three-way valve 68 is connected to a freezer compartment capillary tube (hereinafter referred to as an F capillary tube) 52. Then, the refrigerant passages of the F capillary tube 52 and the R evaporator 34 are united and are connected to the F evaporator 24 and further to the compressor 20.

The operation states of the refrigerator 10 described above will be explained below.

1. Alternate Cooling Operation:

(1) Refrigerating Mode

The three-way valve 68 is changed over so that the refrigerant flows to the R evaporator 34 and the F evaporator 24. Then, when the R fan 36 and the F fan 26 are driven, respectively, cooled air is sent to the refrigerator compartment 14, the vegetable compartment 16 and the freezer compartment 18, thus cooling those compartments. This state will be called a refrigerating mode hereinafter.

(2) Freezing Mode

The three-way valve 68 is changed over so that the refrigerant flows only to the F capillary tube 52 and the F evaporator 24. Then, the only the F fan 26 is driven. In this state, cold air cooled by the F evaporator 24 is sent only to the freezer compartment 18 by the F fan 26, thus dropping the intra-compartment temperature thereof. No cold air is sent to the refrigerator compartment 14. This state will be called a freezing mode hereinafter.

It is noted that the R fan 36 is driven for a certain period of time (five minutes) to defrost the R evaporator 34 after shifting to the freezing mode. Humidified air by that is sent to the refrigerator compartment 14 and the vegetable compartment 16 to prevent the compartments from drying. It also prevents the intra-compartment temperature from rising.

(3) Alternate Cooling Operation

The operation of alternately conducting the freezing mode and the refrigerating mode is called an alternate cooling operation. It is noted that in this case, the difference between resistance of the R capillary tube 50 and the F capillary tube 52 caused by the switching of the refrigerant passage allows evaporation temperature of the R evaporator 34 (−18° C.) to be higher than evaporation temperature of the F evaporator 24 (−25° C.), so that the size of the R evaporator 34 may be reduced and the R evaporator 34 is hardly frosted and foods are hardly dried because temperature of air flowing through the refrigerator compartment 14 and the vegetable compartment 16 is high.

2. Defrosting Operation:

It is conceivable to conduct a defrosting operation in the refrigerator 10 by defrosting the F evaporator 24 and the R evaporator 34 in the same time by the defrosting heaters 28 and 40 or by defrosting only the F evaporator 24 by the defrosting heater 28 from the structure of the refrigeration cycle shown in FIG. 2. Then, in case of the refrigerator 10 of the present embodiment, the defrosting operation of the F evaporator 24 is conducted when an accumulated time of the freezing mode reaches to a certain time, e.g., 10 hours, and the defrosting operation of the R evaporator 34 is conducted once in three times of the defrosting operation of the F evaporator 24.

3. Pre-Cooling Operation:

By the way, when either one of the defrosting operations is to be conducted, it is necessary to lower the intra-compartment temperature of the refrigerator compartment 14, the vegetable compartment 16 or the freezer compartment 18 below the normal temperature before conducting the defrosting operation. It is because no cold air flows in and the intra-compartment temperature rises during the defrosting operation if the temperature is not lowered beforehand. Therefore, the pre-cooling operation for forcibly cooling each compartment is required before conducting the defrosting operation.

4. States of Control:

The states of control of the normal alternate cooling operation, the pre-cooling operation and the defrosting operation described above will be explained based on a flowchart in FIG. 3 and a time chart in FIG. 4.

Figure 3:
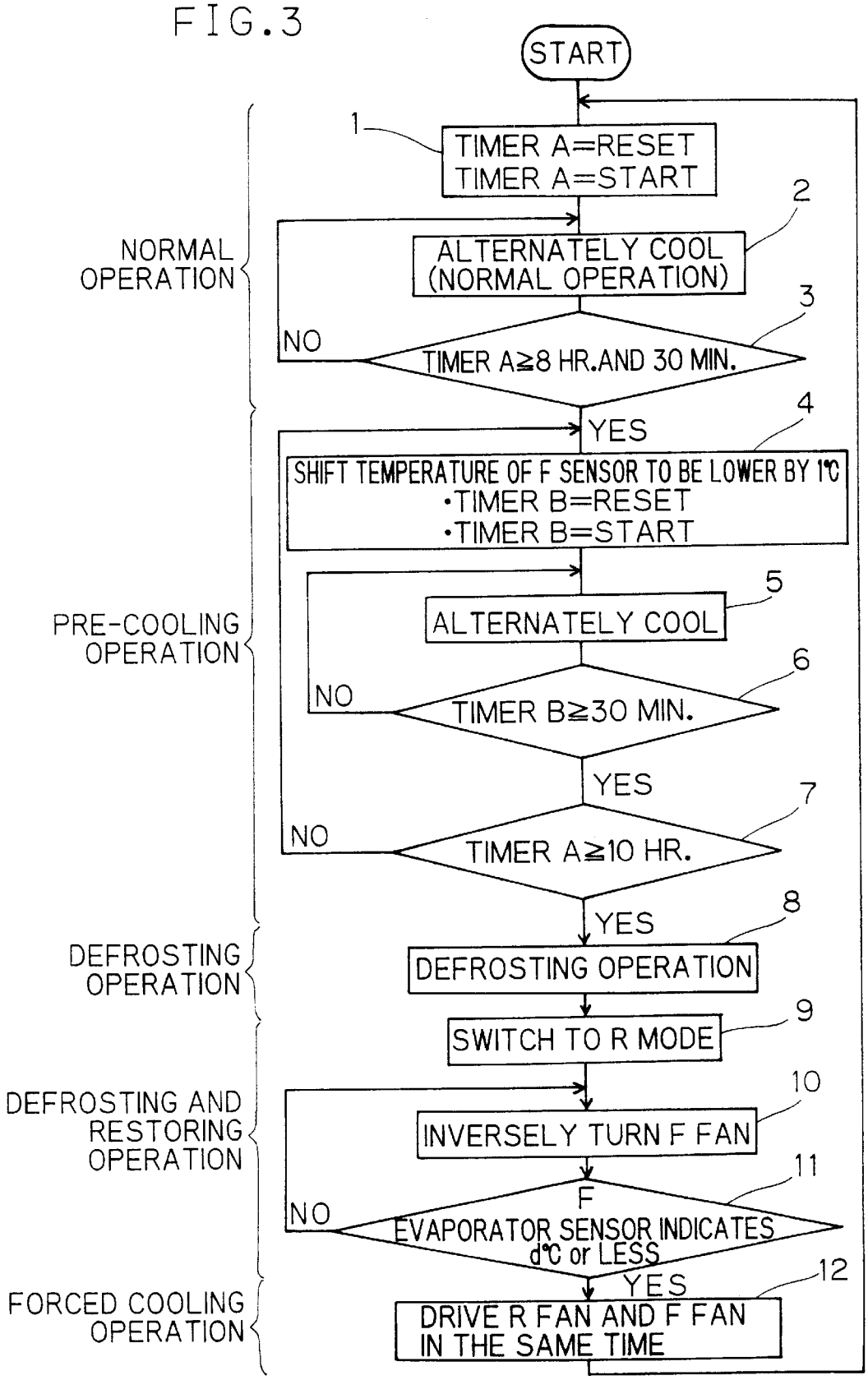
FIG. 3 is a flowchart in cooling the refrigerator.
Figure 4:
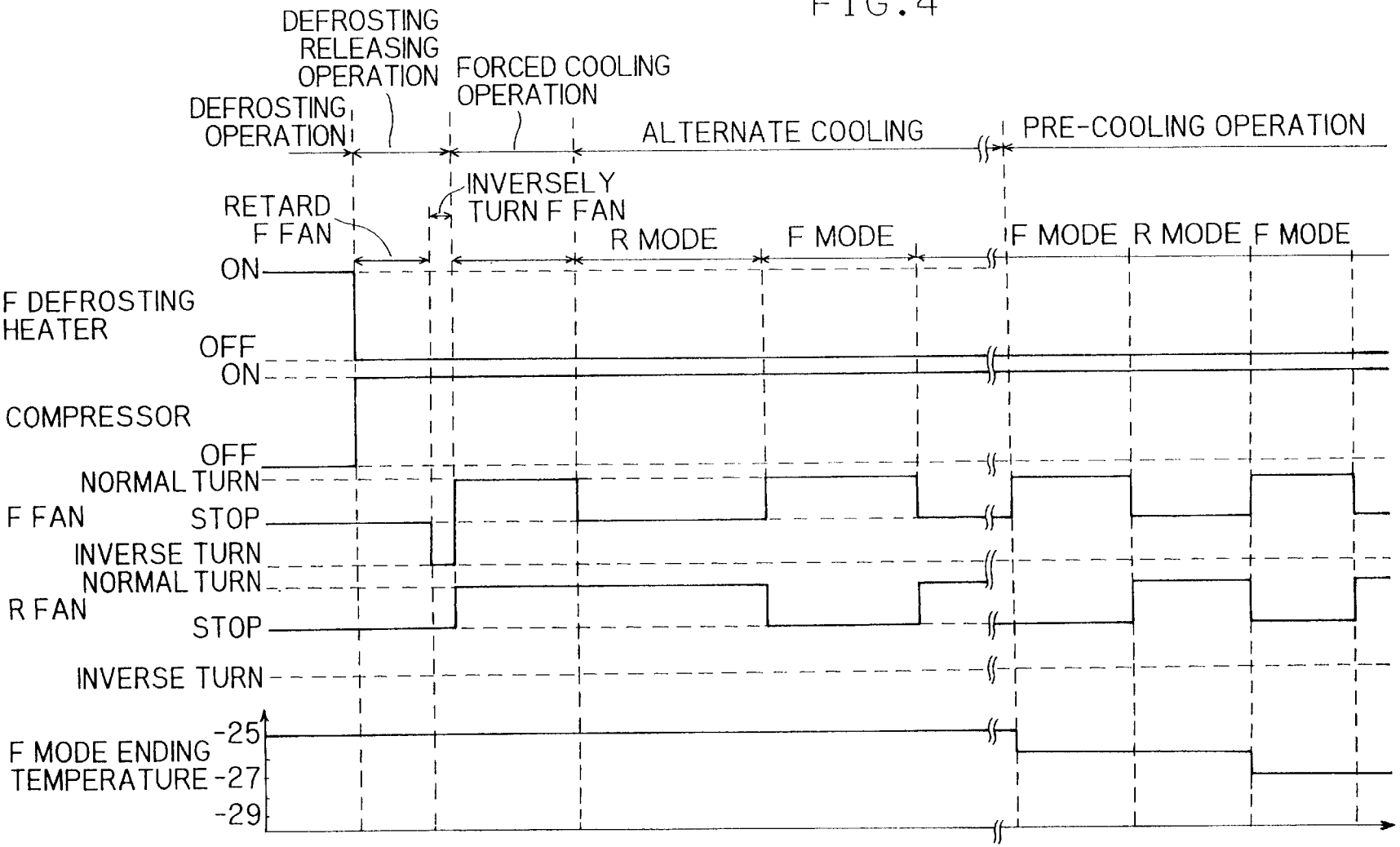
FIG. 4 is a timing chart in cooling the refrigerator.

While the flowchart in FIG. 3 illustrates the case of conducting the defrosting operation of only the F evaporator 24, the same control is carried out also when the F evaporator 24 and the R evaporator 34 are defrosted in the same time.

At first, before explaining about the flowchart, two timers A and B of the control unit 44 will be explained.

The timer A counts an accumulated time of the F mode from the end of the previous defrosting operation and the timer B counts the F mode accumulated time of every 30 minutes from the start of the pre-cooling operation.

The control will now be explained below based on the flowchart in FIG. 3.

The timer A is reset to start to count time in Step 1. Then, the process advances to Step 2.

In Step 2, the normal alternate cooling operation described above is conducted. In this case, temperature for ending the freezing mode is decided depending on temperature, e.g., −12° C., detected by the F sensor 32. Hereinafter, the temperature for ending the normal freezing mode will be called normal freezing mode ending temperature. Then, the process advances to Step 3.

In Step 3, when the timer A counts a predetermined time, e.g., 8 hours and 30 minutes, the process advances to Step 4. Otherwise, the normal alternate cooling operation is continued.

In Step 4, the pre-cooling operation is started. The timer B is reset to start to count time. Further, the temperature of the F sensor 32 for ending the freezing mode is set at pre-cooling freezing mode ending temperature which is lower than the normal freezing mode ending temperature by 1° C. Then, the process advances to Step 5.

In Step 5, the alternate cooling operation is conducted based on the pre-cooling freezing mode ending temperature. Then, the process advances to Step 6.

In Step 6, when the timer B counts 30 minutes, the process then advances to Step 7. Otherwise, the process returns to Step 5.

In Step 7, when the timer A counts 10 hours, the process advances to Step 8. Otherwise, the process returns to Step 4 to continue the pre-cooling operation. Returning to Step 4, the timer B is reset again to start to count time. The pre-cooling freezing mode ending temperature is also shifted to temperature which is lower further by 1° C. and the alternate cooling operation is continued in the same manner. That is, in the processes of Steps 4 through 7, the pre-cooling freezing mode ending temperature is lowered by 1° C. each per every 30 minutes counted by the timer B and the alternate cooling operation is conducted. Thereby, the intra-compartment temperature of the freezer compartment 18 is lowered below the normal temperature of the freezer compartment 18 and the same state with the pre-cooling operation can be attained.

In Step 8, because the pre-cooling operation has been finished, the defrosting heater 28 is actuated to start the defrosting operation. The defrosting operation is finished when temperature detected by the F evaporator sensor 30 reaches to predetermined temperature. Because the defrosting operation of only the F evaporator 24 is conducted, the R evaporator 34 is not defrosted. Therefore, the R fan 36 is driven to thereby defrost the R evaporator 34. Then, air from the R fan 36 flows into the refrigerator compartment 14 via the R evaporator 34 even in the F mode. It allows not only the R evaporator 34 to be defrosted, but also the distribution of the intra-compartment temperature to be improved, the inside of the compartment to be humidified and the freshness of the foods to be kept for a long period of time. It is noted that this control is not carried out when the R evaporator 34 is also defrosted by the heater. Then, the process advances to Step 9.

In Step 9, the mode is switched to the refrigerating mode and then the process advances to Step 10.

In Step 10, the rotation of the F fan 26 is reversed to conduct a defrost recovering operation, due to the following reason. Temperature of air around the F evaporator 24 is high due to the heat caused by the defrosting operation right after the defrosting operation. Therefore, when the F fan 26 is rotated normally right after the end of the defrosting operation, the warm air hits directly against the foods within the freezer compartment 18, thus raising the temperature of the foods. Then, in order to prevent that, the F fan 26 is stopped once (four minutes) and is rotated reversely thereafter (one minute) to return the warm air once from an inlet 62 of the original duct into the refrigerator and air is blown to the freezer compartment 18 via the cold F evaporator 24 thereafter. Then, it is possible to suppress the temperature of the foods from rising. The warm air stays at the upper part of the F evaporator 24 and the foods are affected considerably by the warm air when it is blown out from a blowout hole 60 close to the foods as it is. Meanwhile, the inlet hole 62 is located far from the foods, so that the foods are influenced less by the warm air.

In Step 11, when the F evaporator 24 is fully cooled to d° C., e.g., −20° C., the above-mentioned defrost recovering operation is ended. It is noted that the defrost recovering operation may be ended when the F evaporator 24 reaches to d° C. as described above or after turning the F fan 26 reversely for a predetermined period of time. Then, because the quantity of air of the F fan 26 when it is rotated reversely needs not be great, the F fan 26 is rotated at the least speed in a range which can be set to suppress noise level and power consumption. Then, the process advances to Step 12.

The intra-compartment temperature of the refrigerator compartment 14, the vegetable compartment 16 and the freezer compartment 18 has risen even in the state when the defrost recovering operation has been ended because they have not been cooled for a certain period of time. Then, when the defrost recovering operation ends, a number of revolution of the compressor 20 is maximized and the R fan 36 and the F fan 26 are rotated normally to conduct a forced cooling operation to cool those compartments in the same time in Step 12. Thereby, the temperature of those compartments is lowered. It is noted that when the R fan 36 and the F fan 26 are driven and when their number of revolutions is large, a quantity of exchanged heat becomes large and vaporization temperature becomes high. Because the compartments are warmed in contrary when the F fan 26 is driven in the state in which the vaporization temperature is high, the F fan 26 and the R fan 36 are rotated at the least number of revolutions within the set range so as to minimize the number of revolutions and not to increase the vaporization temperature. Then, the process returns to Step 1. It is noted that when the alternate cooling operation is conducted in Step 2, the temperature of the refrigerator compartment 14 and the vegetable compartment 16 is high because they are not cooled during the defrosting operation from the end of the pre-cooling operation. Therefore, the refrigerating mode is always set to cool the refrigerator compartment 14 and the vegetable compartment 16 when the alternate cooling operation is to be conducted.

5. Modified Examples:

Modified examples of the pre-cooling operation and the defrosting operation described above will be explained.

(1) First Modified Example:

The pre-cooling operation has been always stopped and the defrosting operation has been conducted when the timer A counts 10 hours in Step 7 described above. However, because there is a case when it is on the way of cooling after the elapse of the pre-cooling operation time as described above, the intra-compartment temperature of the freezer compartment 18 may not be fully cooled when the defrosting operation is conducted right after the elapse. Then, when it is on the way of the freezing mode even after the end of the pre-cooling operation time, it is possible to extend the pre-cooling operation until when the freezing mode ends and to start the defrosting operation thereafter.

(2) Second modified Example:

It is also possible to start the defrosting operation after ending the refrigerating mode and further the freezing mode when the pre-cooling operation time ends on the way of the refrigerating mode in the same manner.

(3) Third Modified Example:

Although the pre-cooling freezing mode ending temperature has been lowered every predetermined time in the embodiment described above, it is possible to lower the pre-cooling freezing mode ending temperature every time when the alternate cooling operation is conducted once. When the temperature is lowered per every predetermined time as described above, the numbers of revolutions of the compressor 20 and the F fan 26 are changed and frequency of sound, i.e., quality of sound, is changed, thus causing sound offensive to the ear because the set temperature is lowered on the way of the freezing mode. Therefore, the temperature is changed at the timing of switching the flow of the refrigerant in each cycle so as not to change the sound quality.

INDUSTRIAL APPLICABILITY

As described above, according to the inventive refrigerator, the freezing mode ending temperature is lowered during the alternate cooling operation of the pre-cool operation, the freezer compartment will not be solely and forcibly cooled and the freezer compartment and the refrigerator compartment are cooled alternately, the temperature of the refrigerator compartment will not rise. Further, the freezer compartment may be cooled to temperature lower than normal one by the precooling operation in the same manner with the normal case.

While the preferred embodiments have been described, variations thereto will occur to those skilled in the art within the scope of the present inventive concepts which are delineated by the following claims.

What is claimed is:

1. A controller of a refrigerator comprising a refrigerant passage by connecting a compressor, a condenser, a refrigerator reducing member, a refrigerating evaporator corresponding to a refrigerator compartment, a freezer reducing member and a freezing evaporator corresponding to a freezer compartment;

said refrigerator being capable of realizing an alternate cooling operation of alternately conducting a refrigerating mode of flowing refrigerant to said refrigerating evaporator and to said freezing evaporator via said refrigerator reducing member and a freezing mode of flowing said the refrigerant only to said freezing evaporator via said freezer reducing member by switching said refrigerant passage by a valve member and comprising defrosting heaters provided for said freezing evaporator and said refrigerating evaporator, respectively, so as to be able to conduct a defrosting operation, respectively;

said refrigerator further comprising:

a refrigerator fan for blowing air cooled by said refrigerating evaporator to said refrigerator compartment;

a freezer fan for blowing air cooled by said freezing evaporator to said freezer compartment;

a refrigerator compartment sensor for detecting temperature of said freezer compartment; and a control means for conducting a pre-cooling operation for a preset pre-cooling operation time and for conducting the defrosting operation thereafter;

said control means setting temperature for ending the freezing mode during the pre-cooling operation at pre-cooling freezing mode ending temperature which is lower than normal freezing mode ending temperature by predetermined temperature and conducting the alternate cooling operation until said pre-cooling operation ends based on the pre-cooling freezing mode ending temperature.

2. The controller of the refrigerator according to claim 1, wherein said control means lowers the pre-cooling freezing mode ending temperature stepwise per every predetermined time.

3. The controller of the refrigerator according to claim 1, wherein said control means lowers the pre-cooling freezing mode ending temperature stepwise every time when the alternate cooling operation is conducted once.

4. The controller of the refrigerator according to claim 1, wherein said control means continues the pre-cooling operation until when the freezing mode ends when the mode is the freezing mode when the time reaches to the pre-cooling operation time.

5. The controller of the refrigerator according to claim 1, wherein said control means continues the freezing mode further to continue the pre-cooling operation until the freezing mode ends after ending the refrigerating mode when it is on the way of the refrigerating mode when the time reaches to the pre-cooling operation time.

6. The controller of the refrigerator according to claim 1, wherein said control means drives the refrigerator fan during the defrosting operation when the defrosting operation of only said freezing evaporator is to be conducted.

7. The controller of the refrigerator according to claim 1, wherein said control means switches to the refrigerating mode after ending the defrosting operation and returns to the normal alternate cooling operation after conducting at least a defrost recovering operation of rotating said freezer fan reversely.

8. The controller of the refrigerator according to claim 7, wherein said control means rotates said freezer fan reversely until when temperature detected by a freezing evaporator temperature sensor drop to a certain temperature.

9. The controller of the refrigerator according to claim 7, wherein said control means rotates said freezer fan at the lowest possible set speed.

10. The controller of the refrigerator according to claim 7, wherein said control means starts the normal alternate cooling operation from the refrigerating mode after conducting the defrost recovering operation.

11. The controller of the refrigerator according to claim 7, wherein said control means returns the operation of said refrigerator to the normal alternate cooling operation after conducting a forced cooling operation by driving said refrigerator fan and said freezer fan concurrently for a certain period of time after conducting the defrost recovering operation.

12. The controller of the refrigerator according to claim 11, wherein said control means drives said refrigerator fan and said freezer fan at the lowest possible set speed.

* * * * *